US006921156B2

(12) United States Patent
Childers et al.

(10) Patent No.: US 6,921,156 B2
(45) **Date of Patent: *Jul. 26, 2005**

(54) LARGE THERMAL INK JET NOZZLE ARRAY PRINTHEAD

(75) Inventors: Winthrop D. Childers, San Diego, CA (US); Douglas A. Sexton, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

This patent is subject to a terminal disclaimer.

(21) Appl. No.: 10/439,403

(22) Filed: May 16, 2003

(65) Prior Publication Data

US 2003/0184618 A1 Oct. 2, 2003

Related U.S. Application Data

(63) Continuation of application No. 09/420,141, filed on Oct. 18, 1999, now Pat. No. 6,582,062.

(51) Int. Cl.[7] ..... B41J 2/05

(52) U.S. Cl. ..... 347/59

(58) Field of Search ..... 347/20, 40, 44, 347/48, 50, 59; 29/25.02, 890; 216/27

(56) References Cited

U.S. PATENT DOCUMENTS 6,582,062 B1 * 6/2003 Childers et al. ..... 347/59

* cited by examiner

*Primary Examiner*—Shih-Wen Hsieh

(57) ABSTRACT

The present invention includes as one embodiment a printhead including a flat panel substrate made of a non-crystalline material, an array of inkjet drop generators formed onto the flat panel substrate to define an inkjet printhead and thin film transistors formed on the flat panel substrate that are electrically coupled to the array of ink jet drop generators.

23 Claims, 9 Drawing Sheets

LARGE THERMAL INK JET NOZZLE ARRAY PRINTHEAD

CROSS REFERENCE TO RELATED APPLICATION(S)

This is a continuation of application Ser. No. 09/420,141 filed on Oct. 18, 1999 now U.S. Pat. No. 6,582,062, which is hereby incorporated by reference herein.

FIELD OF THE INVENTION

The present invention includes as one embodiment a printhead including a flat panel substrate made of a non-crystalline material, an array of inkjet drop generators formed onto the flat panel substrate to define an inkjet printhead and thin film transistors formed on the flat panel substrate that are electrically coupled to the array of ink jet drop generators.

BACKGROUND OF THE INVENTION

Thermal inkjet (TIJ) printers are popular and common in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Ink jet printers produce high-quality print, are compact and portable, and print quickly and quietly because only ink strikes a print medium (such as paper).

An ink jet printer produces a printed image by printing a pattern of individual dots (or pixels) at specific defined locations of an array. These dot locations, which are conveniently visualized as being small dots in a rectilinear array, are defined by the pattern being printed. The printing operation, therefore, can be pictured as the filling of a pattern of dot locations with dots of ink.

Ink jet printers print dots by ejecting a small volume of ink onto the print medium. These small ink drops are positioned on the print medium by a moving carriage that supports a printhead cartridge containing ink drop generators. The carriage traverses over the print medium surface and positions the printhead cartridge depending on the pattern being printed. An ink supply, such as an ink reservoir, supplies ink to the drop generators. The drop generators are controlled by a microprocessor or other controller and eject ink drops at appropriate times upon command by the microprocessor. The timing of ink drop ejections generally corresponds to the pixel pattern of the image being printed.

In general, the drop generators eject ink drops through a nozzle or an orifice by rapidly heating a small volume of ink located within a vaporization or firing chamber. The vaporization of the ink drops typically is accomplished using an electric heater, such as a small thin-film (or firing) resistor. Ejection of an ink drop is achieved by passing an electric current through a selected firing resistor to superheat a thin layer of ink located within a selected firing chamber. This superheating causes an explosive vaporization of the thin layer of ink and an ink drop ejection through an associated nozzle of the printhead.

High speed printing systems, such as large format devices and drum printers (which print on a large scale, for example, architectural drawings), use a large array printhead containing arrays of ink drop generators in order to print over a wide area. In general, a large array printhead is preferably defined as greater than 1 inch in extent. Large array printheads have been conceived that embody multiple thermal inkjet substrates that are aligned and attached to a carrier substrate. For example, U.S. Pat. No. 5,016,023 discusses separate silicon thin films formed as TIJ thin-film substrates. However, one problem with this type of large array printhead is that the TIJ thin-film substrates must be mechanically aligned to the carrier substrate, which is costly and may result in inadequate relative alignment between drop generators on the separate substrates.

Thus, there exists a need for a dimensionally precise large array printhead suitable for high-speed printing systems wherein the size of the substrate is not limited. Moreover, there is a need for an inexpensive large array printhead having a single monolithic substrate, so that the carrier substrate is the TIJ substrate and the expense and difficulty of aligning multiple substrates are eliminated.

SUMMARY OF THE INVENTION

To overcome the limitations in the prior art as described above, and to overcome other limitations that will become apparent upon reading and understanding the present specification, the present invention is embodied in a large array printhead having a large array of ink drop generators formed on a single monolithic substrate. The present invention provides an inexpensive large array printhead that uses a single monolithic substrate so that the need to align multiple substrates is alleviated. Moreover, the single monolithic substrate is made from a suitable material so that the size of the substrate is not limited.

The large array printhead of the present invention includes a large array of ink drop generators that are formed on a single monolithic substrate. The printhead includes a driver device circuit (preferably a multiplexing device) that reduces the number of incoming leads to the ink drop generators and decreases the parasitic resistance of the printhead. Preferably, the multiplexing device is on the back of the substrate so that it does not interfere with the printing operations on a print media. The ink drop generators are a layered thin-film structure formed on the substrate using thin-film techniques. These layers include a resistor layer, for heating ink from an ink source to a high temperature to cause an ink drop ejection and a barrier layer, for providing necessary structure to form a firing chamber and ink feed holes, which provide ink to the resistor. These layers also include an orifice layer that contains a nozzle from which the ink drop is ejected. Another embodiment of the invention includes a barrier layer having a plurality of ink feed holes and another embodiment includes a large array printhead having a plurality of chambers that may contain different ink colors.

The present invention is also embodied in a plurality of techniques that are used fabricate the above-described large array printhead. These techniques include etching and patterning the layered thin-film structure on the substrate. In a preferred embodiment, the substrate is etched and patterned first and then the multiplexing device is attached at a later time. Attachment may be accomplished using a several techniques including soldering the device to the substrate. Moreover, flat panel techniques and equipment may be used to fabricate the large array printhead of the present invention.

Other aspects and advantages of the present invention as well as a more complete understanding thereof will become apparent from the following detailed description, taken in conjunction with the accompanying drawings, illustrating by way of example the principles of the invention. Moreover, it is intended that the scope of the invention be limited by the claims and not by the preceding summary or the following detailed description.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the present invention.

Referring now to the drawings in which like reference numbers represent corresponding parts throughout.

DETAILED DESCRIPTION OF THE PREFERRED EMBODIMENTS

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

The present invention is embodied in a large array printhead having a large array of ink drop generators that are formed on a single monolithic substrate. The printhead of the present invention is suitable for high-speed printing systems such as large format printing systems and drum printers. The present invention solves several problems that can exist with large array printheads. For example, a large array printhead formed on a silicon substrate may be limited by the maximum size of silicon wafers available. In addition, the manufacturing cost of a large array printhead may be prohibitive when multiplexing as the substrate size begins to approach the size of a wafer, since only one or a few substrates can then be fabricated per wafer. One alternative is to create a large array printhead by arranging and aligning multiple thermal ink jet (TIJ) printheads on a carrier substrate, but controlling the location of drop generators between substrates may not be adequately controllable.

The large array printhead of the present invention solves these problems by providing a large array of TIJ thin-film ink drop generators formed on a single monolithic substrate. This single substrate eliminates the difficulty of aligning multiple substrates because the TIJ substrate is the carrier substrate. Preferably, the large array of ink drop generators is patterned on the monolithic substrate without the multiplexing devices, which are attached to the substrate at a later time. In addition, the substrate is made of a suitable material to alleviate any wafer size limitations, reduce cost and alleviate any process equipment needed for other costly substrates.

II. Structural Overview

Figure 1:
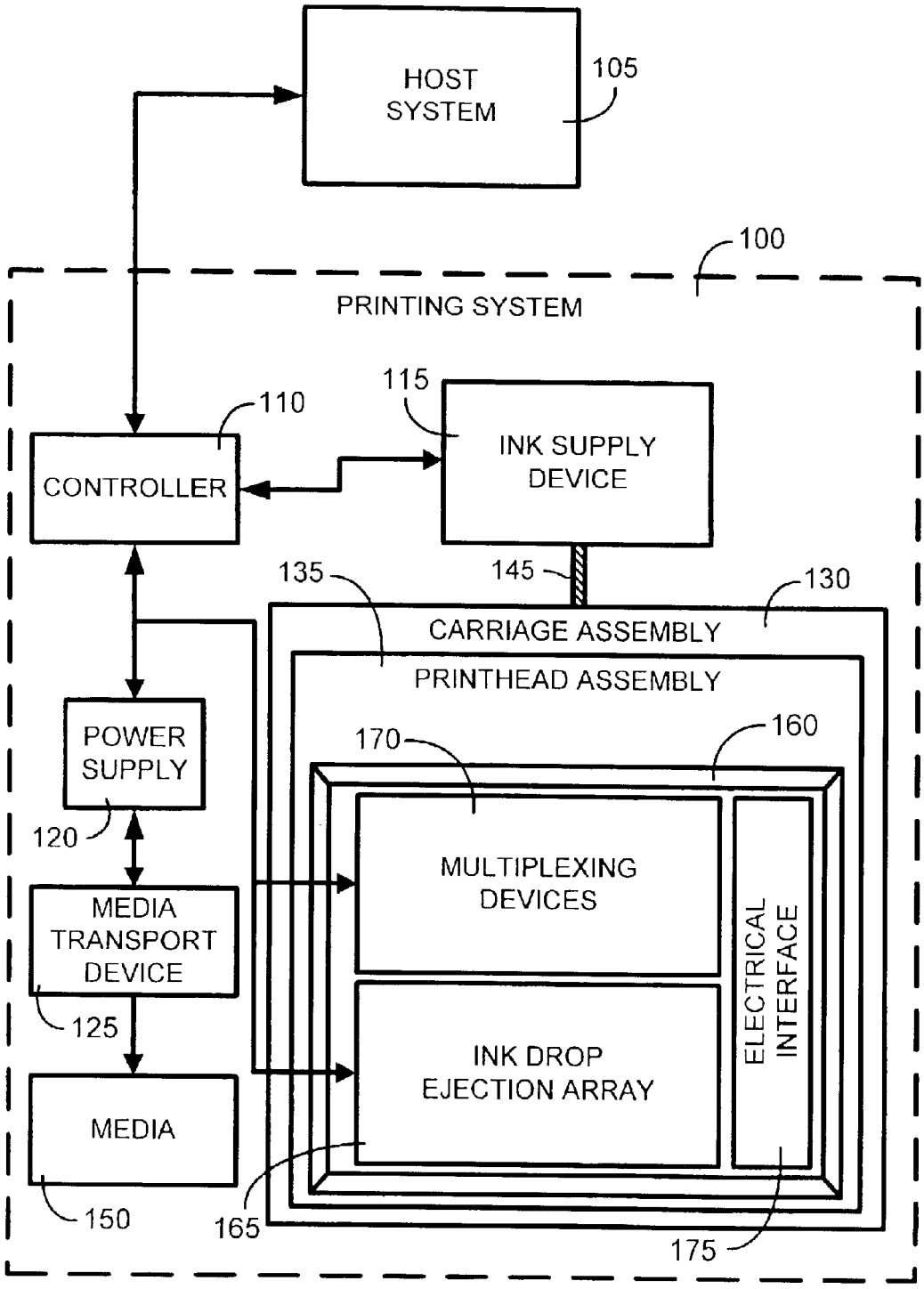
FIG. 1 is a block diagram of an overall printing system incorporating the present invention.

FIG. 1 is a block diagram of an overall printing system incorporating the present invention. The printing system 100 can be used for printing a material, such as ink on a print media, which can be paper. The printing system 100 is electrically coupled to a host system 105, which can be a computer or microprocessor for producing print data. The printing system 100 includes a controller 110 coupled to an ink supply device 115, a power supply 120, a media transport device 125, a carriage assembly 130 and a printhead assembly 135. The ink supply device 115 is fluidically coupled, for example, by a fluid conduit 145 to the printhead assembly 135. The ink supply device selectively provides ink to the printhead assembly 135. The media transport device 125 provides movement of print media 150 relative to the printing system 100. Similarly, the carriage assembly 130 supports the printhead assembly 135 and provides movement of the printhead assembly 135 to a specific location over the print media 150 as instructed by the controller 110.

The printhead assembly 135 includes a single monolithic substrate 160 that is made of any suitable material (preferably having a low coefficient of thermal expansion), such as, for example, ceramic. The printhead assembly 100 further includes an ink drop generator array 165 that contains elements for causing an ink drop to be ejected from the printhead assembly 100. A multiplexing device 170, which reduces the number of incoming leads, is electrically coupled to the ink drop generator array 165. In addition to reducing the number of incoming leads, the multiplexing device also reduces parasitic resistance thereby reducing the amount of energy required to eject an ink drop from the ink drop generator array 165. The printhead assembly 100 also includes an electrical interface 175 that provides energy to the ink drop generator array 165 and the multiplexing device 170.

During operation of the printing system 100, the power supply 120 provides a controlled voltage to the controller 110, the media transport device 125, the carriage assembly 130 and the printhead assembly 135. In addition, the controller 110 receives the print data from the host system 105 and processes the data into printer control information and image data. The processed data, image data and other static and dynamically generated data is exchanged with the ink supply device 115, the media transport device 125, the carriage assembly 130 and the printhead assembly 135 for efficiently controlling the printing system 100.

Figure 2:
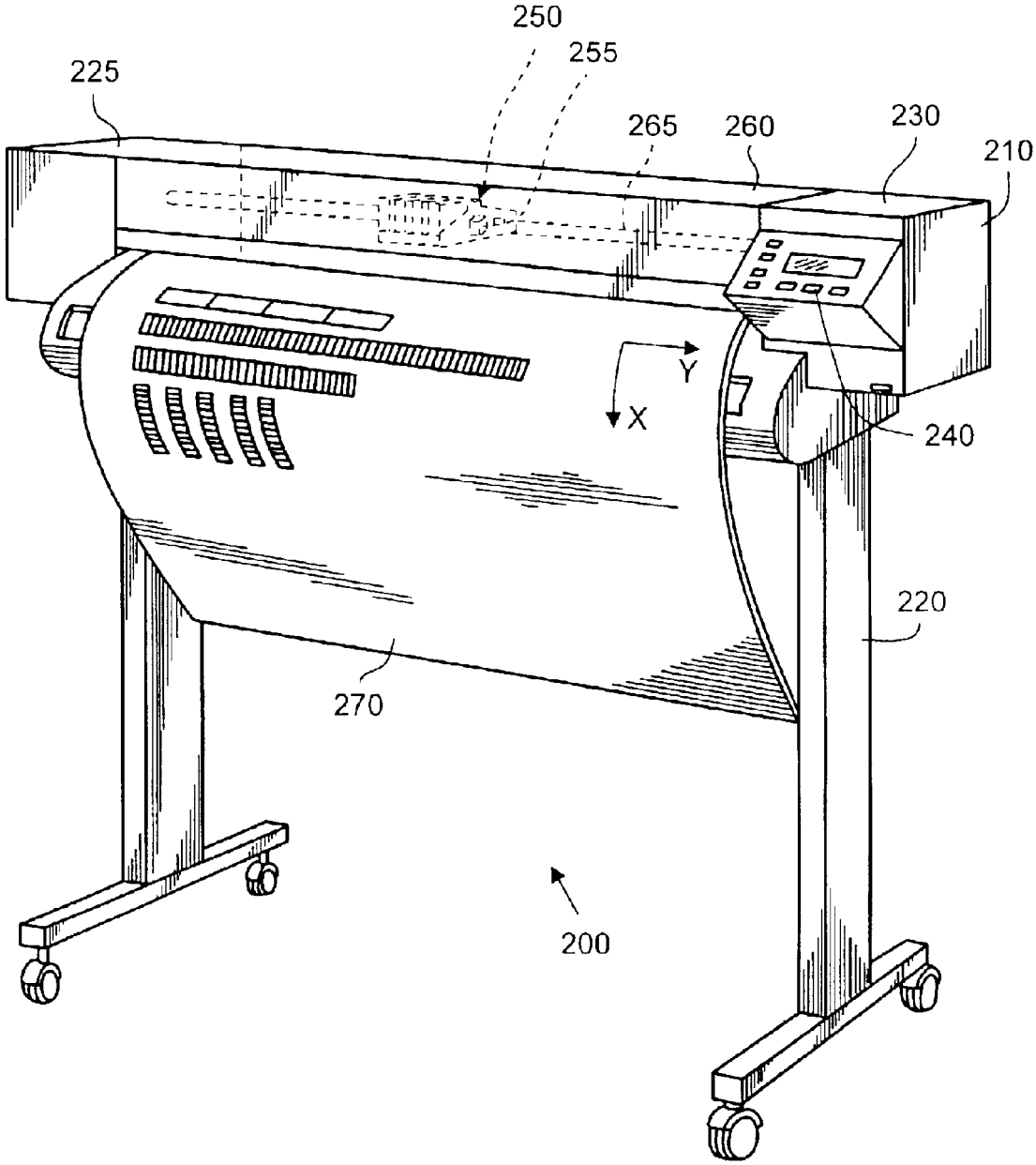
FIG. 2 is a perspective view of an exemplary high-speed large format printing system that incorporates the invention and is shown for illustrative purposes only.

FIG. 2 is a perspective view of an exemplary high-speed large format printing system 200 that incorporates the invention and is shown for illustrative purposes only. The printing system 20 includes a housing 210 mounted on a stand 220. The housing 210 has a left media transport mechanism cover 225 and a right media transport mechanism cover 230 housing a left media transport mechanism (not shown) and a right media transport mechanism (not shown), respectively. A control panel 240 is mounted on the right media transport mechanism cover 230 and provides a user interface with the printing system 200.

A printhead assembly 250 is mounted on a carriage assembly 255 and are both shown under a transparent cover 260. The carriage assembly 255 positions the printhead assembly 250 along a carriage bar 265 in a horizontal direction denoted by the "y" axis A print media 270 (such as paper) is positioned by the media transport mechanism (not shown) in a vertical direction denoted by the "x" axis.

Figure 3A:
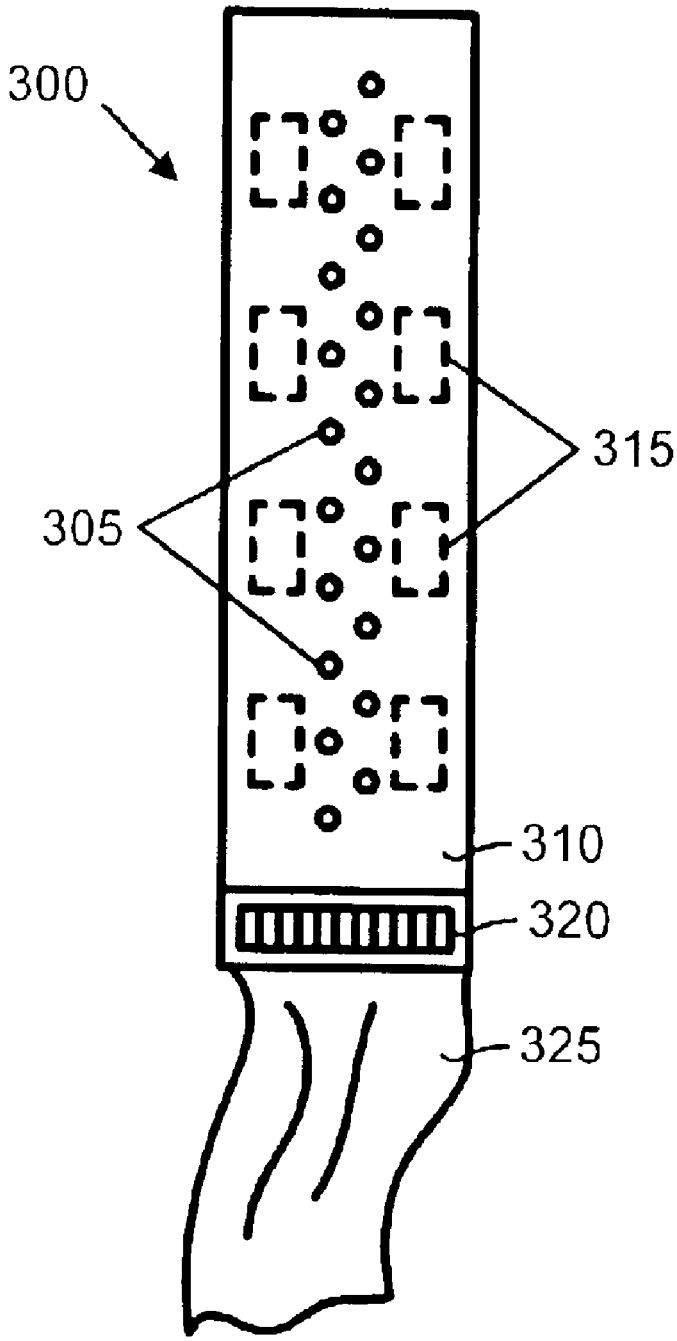
FIG. 3A is a front view of a large array printhead of the present invention.

FIG. 3A is a front view of a large array printhead 300 of the present invention. The printhead 300 includes an array of ink drop generator elements (not shown) that are formed on a single monolithic ceramic substrate 310. The array of ink drop generator elements includes an array of orifices 305, where each orifice is preferably a nozzle. The orifice array 305 is preferably approximately 2 to 8 inches in length, but may range in length from 0.5 inches to the width of a large format drawing. In a preferred embodiment, the orifice array 305 is 2.5 inches long, has staggered nozzle spacing and has a resolution of 600 dots per inch (dpi) created by two rows of nozzles (each row having a resolution of 300 dpi). Preferably, there are approximately 1500 nozzles formed on the printhead 300.

A plurality of multiplexing devices 315 are electrically coupled to the ink drop generator elements via leads (not shown) formed in the substrate 310. The plurality of multiplexing devices, which are discussed further below, are located on the back of the substrate 310 and are shown by dashed lines. These devices 315 reduce the number of leads that need to be formed in the substrate 310 and reduce parasitic resistance. As stated above, the plurality of multiplexing devices 315 are not formed or patterned into the substrate 310 but instead are attached to the substrate 310 after a process of patterning circuitry onto substrate 310. As discussed below, a preferred method of attaching each multiplexing device 315 is using what is commonly known as a "flip chip" technology, whereby each device 315 is electrically connected to the substrate 310 using solder. Other methods of attachment are discussed below. Energy for the printhead 300 is delivered through an electrical interface 320 that is connected to a power source by an electrical cable 325.

Figure 3B:
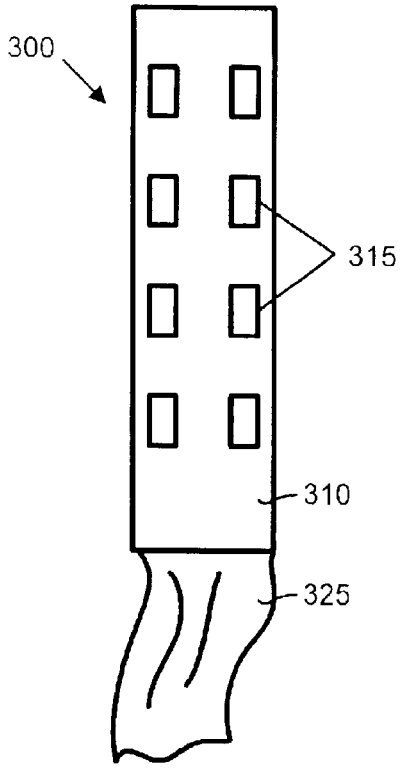
FIG. 3B is a back view of the large array printhead of FIG. 3A.

FIG. 3B is a back view of the large array printhead 300 of FIG. 3A. This view clearly shows the plurality of multiplexing devices 315 mounted on the back (the side opposite an end where an orifice array is located) of the substrate 310 to avoid spacing concerns between the printhead 300 and a print media (not shown). Mounting the plurality of multiplexing devices 315 on the back of the substrate 310 also alleviates any material compatibility concerns. Preferably, the plurality of multiplexing devices 315 is arranged along the rows of orifices to simplify conductor lithography and further minimize parasitic resistance. Energy is supplied to the printhead 300 through an electrical cable 325.

Figure 3C:
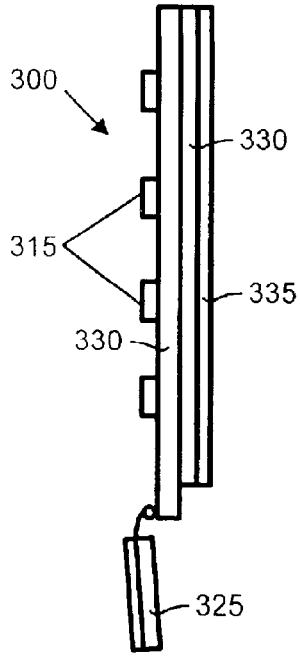
FIG. 3C is a side view of the large array printhead of FIGS. 3A and 3B.

FIG. 3C is a side view of the large array printhead 300 of FIGS. 3A and 3B. The plurality of multiplexing devices 315 are attached to the back of the substrate 310. Further, the electrical cable 325 provides power for the large array printhead 300. A barrier layer 330 overlies the substrate 310 and houses ink feed holes (not shown) that, as described below, provide ink to a plurality of ink drop generators, each of which include a firing chamber (not shown). An orifice layer 335 includes a plurality of nozzles through which ink drops are ejected and deposited on a print media.

Figure 4A:
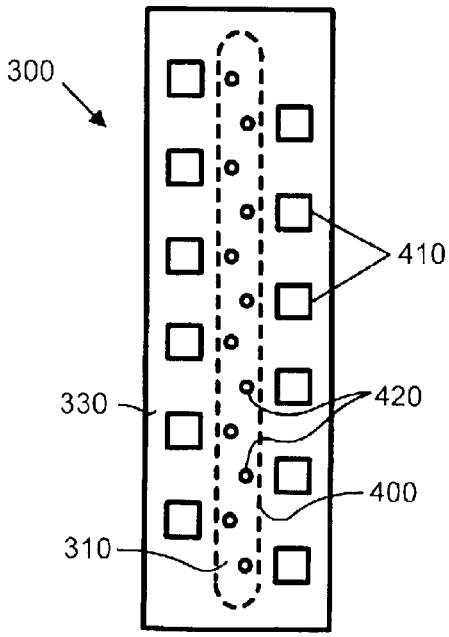
FIG. 4A is a front view of the large array printhead of FIG. 3 with the orifice layer removed.

FIG. 4A is a front view of the large array printhead 300 of FIG. 2 with the orifice layer removed. The barrier layer 330 is the topmost layer (since the orifice layer 335 is removed) and overlies the substrate 310. A ink feed channel 400, shown by a dashed line, is formed in the substrate 310 and provides ink to a plurality of firing chambers (not shown) and resistors 410. The firing chambers and resistors 310 are a layered thin-film structure and are part of the ink drop generators that provide for the ejection of an ink drop from the large array printhead 300. The ink feed channel 400 is indicated by a dashed line in FIG. 4A, because the channel 400 only partially passes through the thickness of the substrate 310. A plurality of ink feed holes 420 are formed in a thin film layer that overlies the ink feed channel 400. In a preferred embodiment, the thin film layer is at least one of the thin film layers that are used to form heater resistors 410 on substrate 310. The plurality of ink feed holes 420 allow ink to flow from the ink feed channel 400 into the firing chambers so that the ink is capable of being heated by the resistors 410.

Figure 4B:
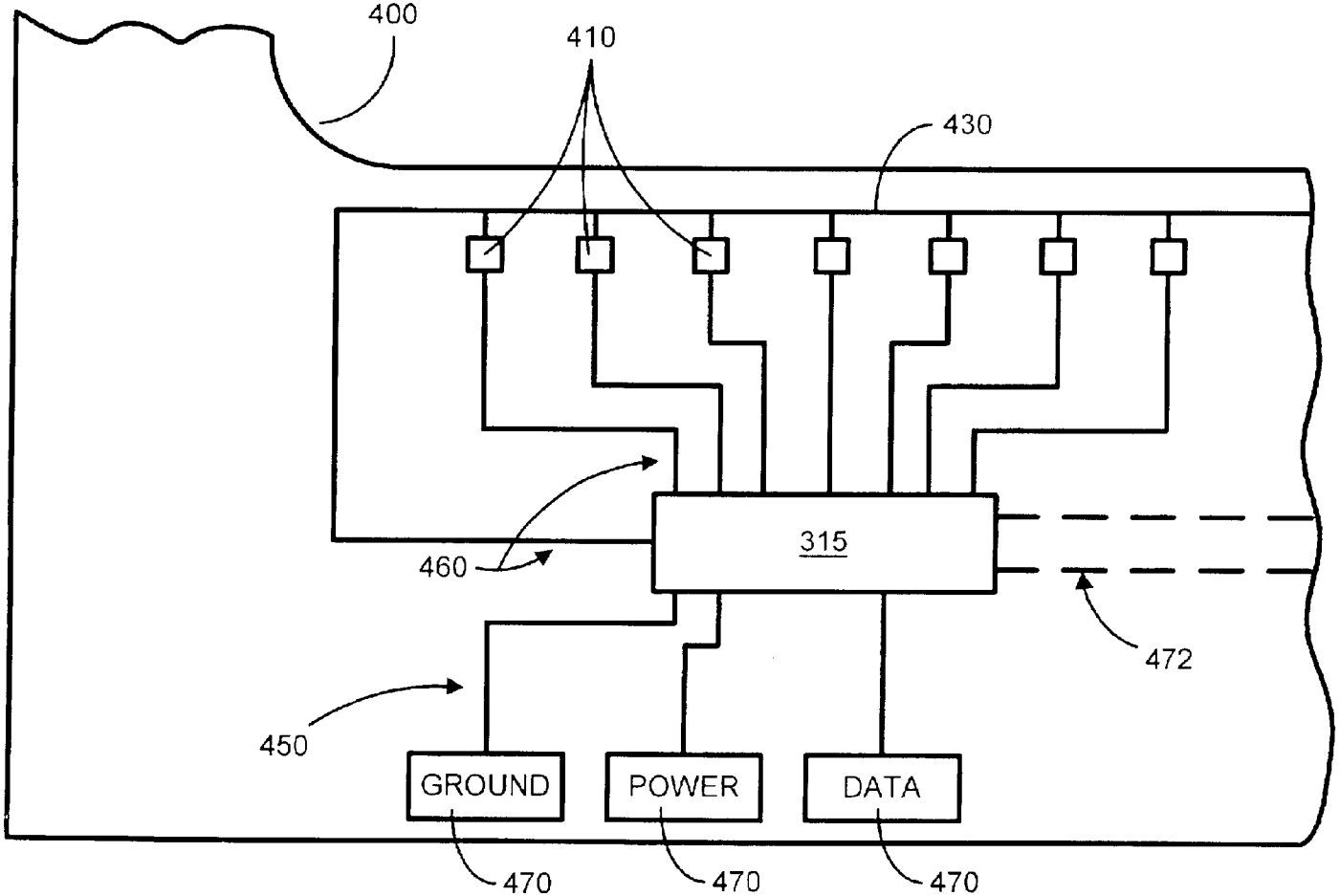
FIG. 4B illustrates a corner portion of the substrate in FIG. 4A with no orifice, barrier layers or ink feed holes shown for simplicity.

FIG. 4B illustrates a corner portion of the substrate shown in FIG. 4A with no orifice or barrier layers or ink feed holes shown for simplicity. As indicated before, during printhead operation flows from central ink feed slot 400 and to firing resistors 410. Each firing resistor 410 receives electrical pulses from one multiplexing device 315 and is coupled to a return line 430. The device has input lines 450 and output lines 460. Input lines 450 can include a power line for providing power from power source to multiplexing device 315, a data line for providing resistor firing data from a data source to multiplexing device 315, and a ground line. The input lines are each connected to an input pad 470 that is in turn coupled to an external circuit such as circuit 325 depicted in FIGS. 3B and 3C. Although FIG. 4B shows a particular location for coupling to lines 450, the coupling can occur suitably along the periphery of substrate 300. Substrate 300 may include traces 472 connected to the multiplexing device 315 for coupling to alternative or additional inputs.

The multiplexing device 315 can include registers for storing data related to the operation of firing resistors 410, along with transistors for energizing resistors 410. In a preferred embodiment, substrate 300 includes one power transistor for each output line 460.

Figure 5:
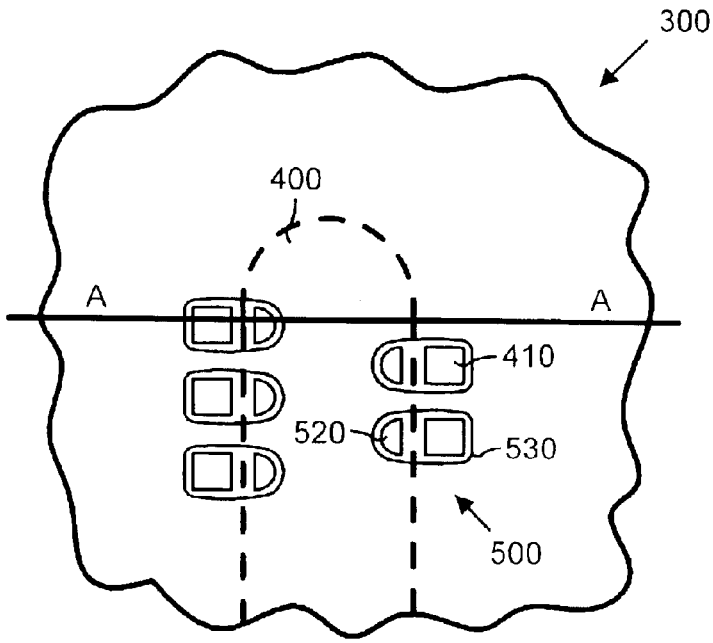
FIG. 5 is one embodiment of the present invention showing a detailed representation of several firing chambers of the large array printhead of FIG. 4A with the orifice layer removed.

FIG. 5 is one embodiment of the present invention showing a detailed representation of several firing chambers of the large array printhead 300 of FIG. 4A with the orifice layer removed. A firing chamber 500 includes the resistor 410 that is paired with an ink feed hole 520. A barrier opening 530 surrounds the resistor 410 and ink feed hole 520 combination to allow ink to pass from the ink feed channel 400 through the ink feed hole 520 to the resistor 410. A nozzle (not shown) is formed in the orifice layer and is positioned over the resistor 410.

Figure 6:
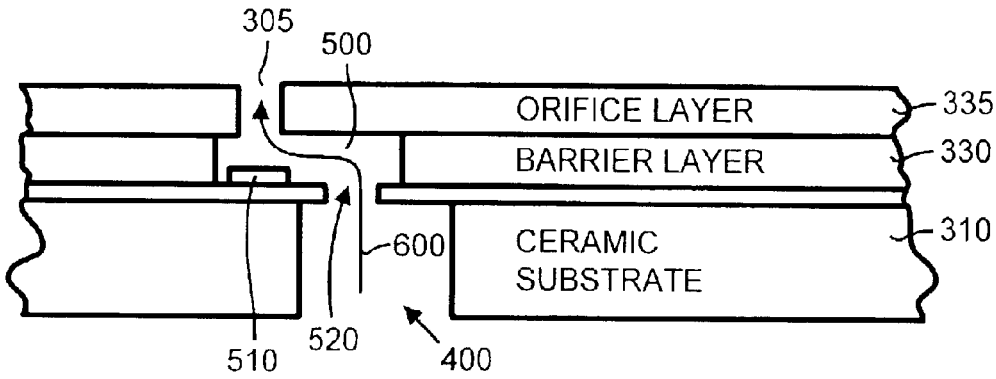
FIG. 6 is a cross-sectional side view taken across AA' of FIG. 5 showing the ink flow path through a nozzle.

FIG. 6 is a cross-sectional side view taken across AA' of FIG. 5 showing an ink flow path through the firing chamber 500 and the nozzle 305. The details of the layered thin-film structure including the firing chamber are discussed below. FIG. 6 illustrates the cross-section of a single firing chamber 500 formed from the ceramic substrate 310, the barrier layer 330 overlying the substrate 310 and the orifice layer 335 overlying the barrier layer 330. The ink feed channel 400 is formed in the substrate 310 and carries ink from an ink source (not shown) to the firing chamber 500 via the ink feed hole 520. The ink passes over the resistor 410, which is capable of heating the ink and ejecting an ink drop from the nozzle 305. The arrow 600 illustrates the flow of ink from the ink feed channel 400 to the resistor 410 and out through the nozzle 305.

Figure 7:
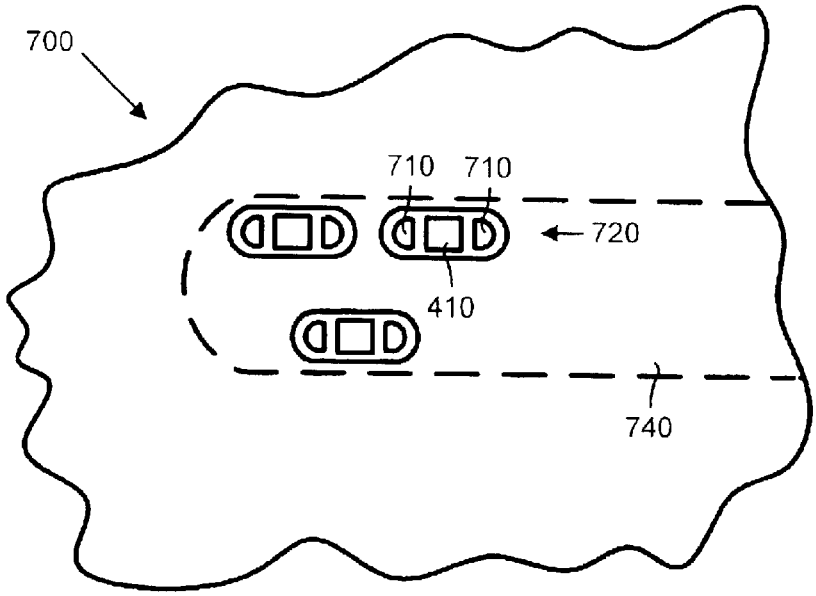
FIG. 7 is another embodiment of the present invention showing a detailed representation of a large array printhead with the orifice layer removed and having multiple ink feed holes.

FIG. 7 is another embodiment of the present invention showing a detailed representation of several firing chambers of the large array printhead of FIG. 4A with the orifice layer removed. This embodiment includes most of features of the embodiment shown in FIG. 5 except the large array printhead 700 in this embodiment includes a plurality of ink feed holes 710 for a firing chamber 720. One advantage of having a plurality of multiple ink feed holes for each firing chamber is that the fluid flow resistance of ink from the ink feed channel 740 into the firing chamber 720 is reduced. Another advantage is that if one of the multiple ink feed holes becomes obstructed, the plurality of multiple feed holes offers an alternative ink path between ink feed channel 740 and firing chamber 720. In this embodiment, the resistor 410 is adjacent multiple ink feed holes 710. Ink flows from an ink feed channel 740 through the multiple ink feed holes 710 and over the resistor 410. Although FIG. 7 illustrates two ink feed holes 710, other embodiments of the invention include a plurality of more than two ink feed holes for each firing chamber.

Figure 8:
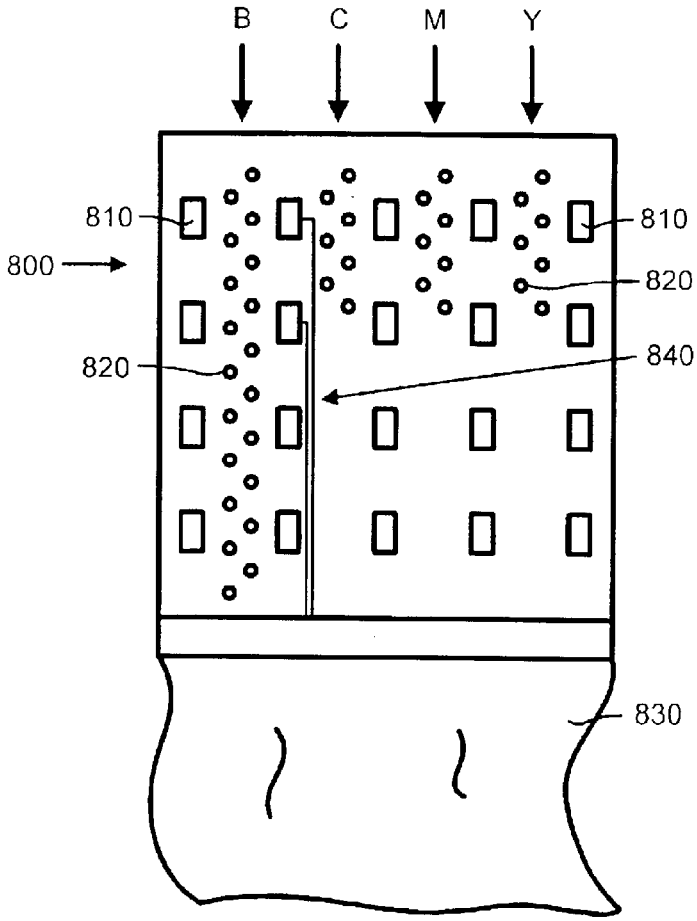
FIG. 8 is another embodiment of the present invention showing a multi-chamber large array printhead of the present invention.

FIG. 8 is another embodiment of the present invention showing a multi-chamber large array printhead 800 of the present invention. This embodiment is similar to the embodiment shown in FIGS. 3A through 3C except that there are a plurality of chambers each containing a different color of ink. For example, in FIG. 8 there are four different colors of ink on the large array printhead 800 including black (B), cyan (C), magenta (M) and yellow (Y). Each row represents a different color ink, and each row includes multiplexing devices 810 (preferably attached to the back of the substrate 800) and nozzles 820 for ejecting ink drops. Similar to the embodiment of FIGS. 3A through 3C, signals for activating for the large array printhead 800 are supplied via an electrical cable 830. Traces 840 route signals from the cable 830 to the multiplexing devices 810 in a manner similar to that discussed with respect to FIG. 4B.

Layered Thin-film Structure

Figure 9:
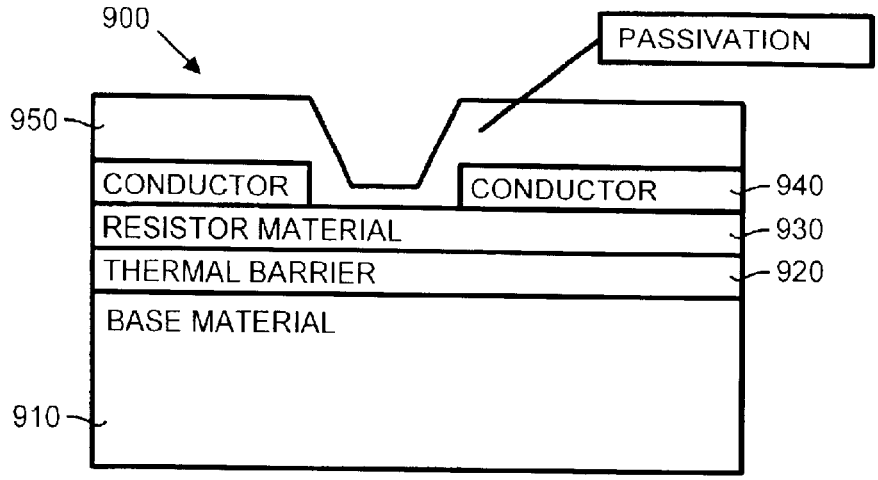
FIG. 9 is a cross-sectional side view of an exemplary layered thin-film structure that may be used with any of the embodiments of the present invention.

FIG. 9 is a cross-sectional side view of an exemplary layered thin-film layered structure that may be used with any of the embodiments of the present invention. Not shown in FIG. 9 are any multiplexing circuitry that may be formed into a substrate. The layered thin-film structure 900 of FIG. 9 includes a substrate 910 is made of any suitable material that has a low coefficient of thermal expansion (ceramic is a preferred material). Overlying the substrate 910 is a thermal barrier 920 that is positioned to direct heat toward the ink rather than the substrate 910. In an exemplary embodiment the thermal barrier material is silicon dioxide.

A resistor material 930 is disposed over the thermal barrier 920 to provide enough heat to vaporize the ink and cause an ink drop to be ejected. In a preferred embodiment the resistor material is tantalum aluminum. Overlying at least part of the resistor material is conductive material 940 that routes power to the resistor material 930 and provides interconnections between the resistor material 930 and the multiplexing devices (not shown) discussed above. Preferably, the power is routed to the resistor material 930 in the form of conductive traces formed from aluminum. Finally, a passivation layer 950 is provided to protect the resistor material 930 from damage. In a preferred embodiment, the passivation layer 950 is silicon carbide that overlays silicon nitride. Further, an optional metal layer (not shown) is preferably provided atop the passivation layer 950 to protect the underlying thin-film layers from damage due to, for example, ink drop collapse and cavitation cause by resistor firing.

Multiplexing Devices

Although a multiplexing device is important to include on a large array printhead because it reduces the number of power inputs to drop generators on the printhead and reduces parasitic resistance, forming the multiplexing device directly into the substrate can be difficult or impossible if the substrate is a non-silicon substrate. The present invention addresses/this problem by providing the following embodiments that provide a means whereby such a multiplexing device may be used in a large array printhead without the need for the large array substrate to contain silicon (i.e. a crystalline material).

In a preferred embodiment, separately fabricated silicon-based multiplexing devices are bonded to the substrate. One method of attaching these devices is with a methodology commonly referred to as "flip chip" technology. In this embodiment, the substrates containing the multiplexing devices are transistor arrays with a plurality of address lines and a plurality of primitive lines, where the number of nozzles is the number of address lines time the number of primitive lines. In an alternative embodiment the substrates containing the multiplexing devices can be serial devices having a plurality of lines including, for example, incoming power lines, data lines and firing lines.

Another embodiment includes a silicon-based multiplexing device that provides power to the printhead. A lower powered logic circuitry is formed from thin-film transistors (TFTs) on the base substrate. In this embodiment, the TFT circuitry may be used as monitor circuitry on the substrate that could monitor, for example, thermal and pressure states of the printhead. Moreover, higher current TFTs may be used for all of the logic and multiplexing circuitry as lower current and higher resistance resistors are increasing used to reduce parasitic resistance. The preferred method of patterning circuitry on the substrate is with flat panel technology, which is used to produce the TFTs.

III. Fabrication Overview

Figure 10:
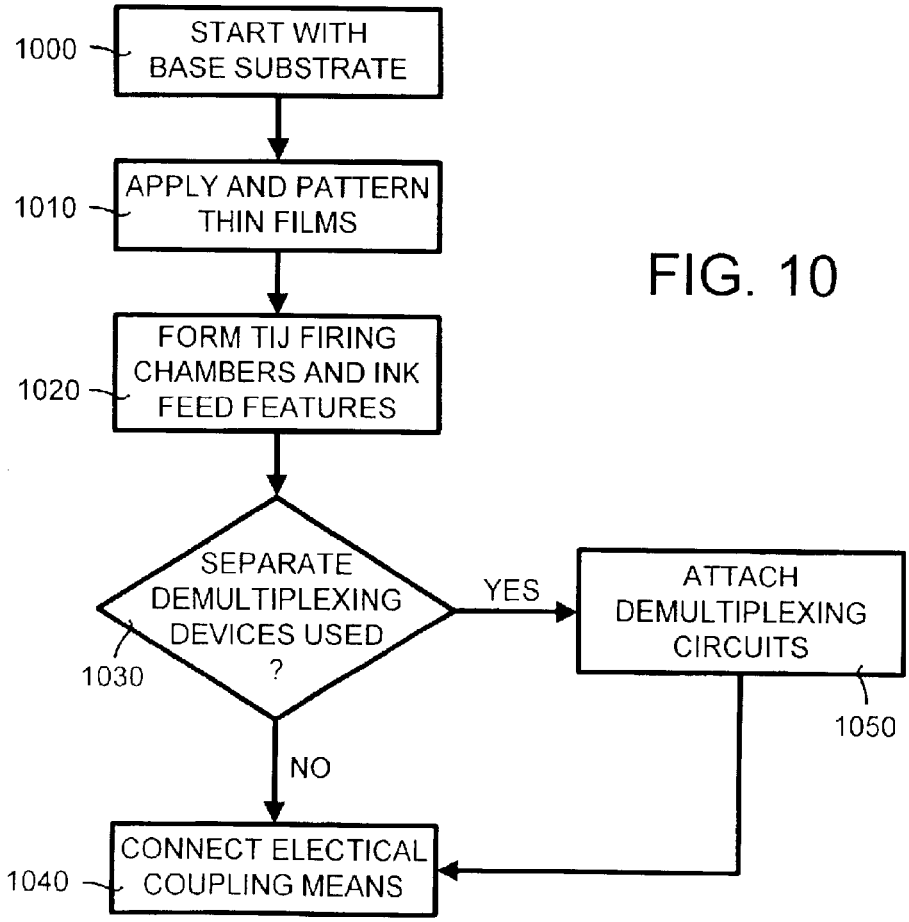
FIG. 10 is an overall flow diagram illustrating an overview of the fabrication of the large array printhead of the present invention.

FIG. 10 is an overall flow diagram illustrating an overview of a process for fabricating the large array printhead of the present invention. First, a base substrate made of a non-monocrystaline material (such as ceramic) is provided (box 1000). Utilizing the non-monocrystalline material (i.e. a non-silicon material) allows the process to use a large non-circular shaped substrate such as a large rectangular panel. Panels such as this can take on a variety of sizes, such as 12 inches by 12 inches, or even 18 inches on a side. Although ceramic is a preferred material, the substrate material can be any material that meets the electrical, thermal, mechanical and material compatibility requirements of the substrate. Alternatively, if a crystalline material having a sufficiently sized panel is available, then a crystalline material substrate may be used.

Next, the thermal ink jet thin-film layers that define the resistors, conductors and passivation layers are applied to the substrate and patterned (box 1010). Then the ink feed channels and thin-film patterns are formed on the substrate along with the ink feed holes (box 1020). In one embodiment, the ink feed channels are formed first, using a process such as etching, followed by the patterning of the thin-films using a photolithographic process. In a preferred embodiment, flat panel display photolithographic equipment is used.

If multiplexing devices are not separate from the substrate (box 1030), an electrical coupling means is connected to the large array printhead (box 1040) to couple power from a power source to the printhead. Otherwise, in a preferred embodiment, the multiplexing devices are separate from the substrate and must be attached (box 1050). As discussed above, there are several methods for attaching the multiplexing devices to the substrate including, for example, using a "flip chip" bonding process.

After the multiplexing devices are attached to the substrate the electrical coupling means is connected to the large array printhead (box 1040). A plurality of connectors can be electrically coupled including, for example, cables and pin connectors.

Three working examples of the fabrication of a large array printhead will now be discussed. Although the large array printhead may be a variety of shapes, in these working examples and in a preferred embodiment the printhead is a rectangular shape. In a first working example a rectangular panel of a ceramic material is used to form a plurality of large array printheads. This panel is large enough to allow the formation of more than 10 printheads, and preferably about 100 printheads. The panel is preferably about 12 by 12 inches in extent.

The rectangular panel is planarized, which means that the ceramic substrate is glazed. Other types of panel materials may require different planarizing methods. Next, a thermal barrier is deposited onto the substrate (in this working example the thermal barrier material is silicon dioxide). The glaze itself may act as the thermal barrier.

Resistor material (such as tantalum aluminum) is deposited over the thermal barrier and conductor material (such as aluminum) is at least partially deposited over the conductor material. In a preferred embodiment, the resistor material and conductor material are deposited by a vacuum deposition process (such as vapor deposition or sputtering).

Using flat panel exposure and developing methods, along with etching, the resistor and conductor pattern is then patterned on the substrate. For each etch step, a photopolymer first is coated on the substrate. Next, the photopolymer is exposed in a flat panel exposure system. Finally, the photopolymer is developed leaving exposed regions of the thin films below. In this way, the exposed regions of the thin films may be selectively etched.

One method to form the resistor and conductor pattern is to etch the conductor into a discontinuous strip to define the resistor length and then etch the resistor layer to define the resistor width. One method of forming a resistor/conductor pattern is found in U.S. Pat. No. 4,809,428, the entire contents of which are hereby incorporated by reference. A passivation layer is applied over the resistor layer and the preferred material is a bilayer arrangement of silicon nitride and silicon carbide.

A passivation layer, preferably a bilayer made of silicon nitride and silicon carbide, is applied over the resistor layer. The passivation layer is then etched to provide electrical connections and conductors are then applied and patterned. One variation of this technique is described in U.S. Pat. No. 4,862,197, the entire contents of which are hereby incorporated by reference. A barrier layer is applied over the passivation layer, and in this working example the material is a photopolymer (such as a dry film). The barrier layer is then exposed and developed, using aforementioned flat panel exposure and developing system.

Ink feed channels are then etched or mechanically formed in the substrate. In this first working example, the ink feed channels are formed completely through the substrate. An orifice layer is then placed over the barrier layer. Multiplexing devices are attached to the substrate using the "flip chip" technology described above. Electrical connections are then made to electrically couple the large array printhead to a power source. In this working example, the electrical connections are made using a flexible circuit such as a TAB or solder bonded to the substrate.

In a second working example, the fabrication process is similar to the first working example with the following exceptions. In this second working example, at least some of the thin film layers are allowed to extend over the region of the ink feed channel. During the patterning process for the thin films, ink feed holes are formed out of the thin films over the region where the ink feed channel is to be formed. The barrier and orifice layers are applied as a single photopolymer layer. Next, the mask material is patterned on the back side of the substrate and the back side is etched to form an ink feed channel that extends from the back side of the substrate to the ink feed holes formed in the thin films. The barrier/orifice layer is then exposed and developed to form the barriers and nozzles. Multiplexing devices are attached to the substrate and the electrical connections are made using a flexible circuit.

In a third working example, the fabrication process is similar to the second working example except for the following. A barrier layer is applied as a single layer and, similar to the first working example, is a photopolymer (such as a dry film) that is exposed and developed to form the barrier layer. A mask material is patterned on the back side of the substrate and then etched to form an ink feed channel that extends from the back side of the substrate to the ink feed holes formed in the thin film layers. An orifice layer is then aligned and attached to the barrier layer, and can be made from nickel, a polymer, a glass or a ceramic. Multiplexing devices are then attached to the base substrate and electrical connections are made.

Figure 11:
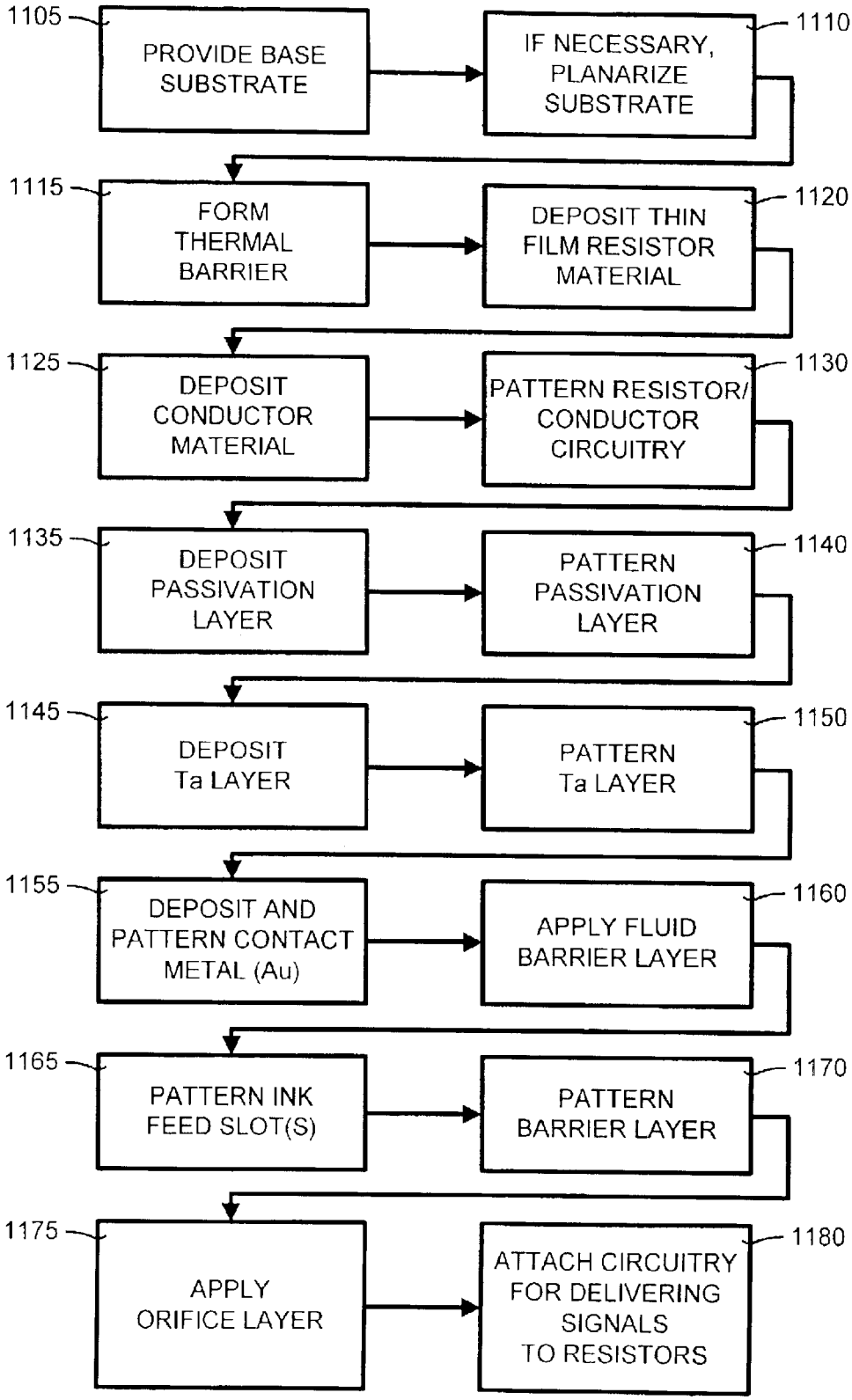
FIG. 11 is a flow diagram illustrating the details of fabrication of one embodiment of large array printhead of the present invention.

FIG. 11 is a flow diagram illustrating the details of fabrication of one embodiment of a large array printhead of the present invention. Referring to FIG. 11 along with FIGS. 3–6, a base substrate of ceramic is provided (box 1105). If necessary, the substrate is planarized using a glaze process (box 1110). Next, a thermal barrier layer is formed (box 1115). In this exemplary embodiment, the thermal barrier is silicon dioxide ($SiO_2$), formed either by a vapor deposition process or by an oxidation process. Next, the thin film resistor material is deposited (box 1120). In this exemplary embodiment, the material is tantalum aluminum (TaAl), and is sputter deposited.

Over the tantalum aluminum a conductor layer of aluminum (Al) is deposited (box 1125), preferably by sputtering. The TaAl and Al then is patterned to form the resistor conductor circuitry (box 1130). In this embodiment, the aluminum layer is first etched to form discontinuous strips having a gap between aluminum trace portions. The resultant gap formed in the aluminum layer defines a resistor length. Next, the tantalum aluminum is etched to provide a resistor width. Of course, alternatively, this order can be reversed wherein a first etch defines the resistor width and a second etch defines the resistor length.

Once the resistor conductor pattern is defined a protection layer is formed over the resistors. In this exemplary embodiment, a passivation layer including layers of silicon nitride and silicon carbide are deposited over the resistor (box 1135). Next, a dry etch process is used to define the lateral extent and pattern of the passivation layer (box 1140). In general, the passivation layer preferably is patterned everywhere except where electrical power connections are made. Referring back to FIGS. 3 through 4B, openings in the passivation allow pads 470 for coupling power devices 315 and external circuitry 325 to be provided. The passivation is also patterned in the region of ink feed slot 400 to provide ink feed holes 520 (see FIGS. 4A, 5, and 6).

After the passivation layer is patterned, a layer of metal is deposited over the passivation layer (box 1145). The metal, which in this example is tantalum (Ta), is then etched to leave at least a portion of the tantalum over the resistors so that a top portion of a protection layer is formed (box 1150). Finally, referring to FIG. 3A, a contact material (such as gold) is deposited and patterned to provide a contact material to facilitate the coupling of devices 315 and circuitry 325 to the substrate 300 (box 1155).

After completion of the thin films a barrier material is applied over the thin films (box 1160). In this example, the barrier material is a polymer that is laminated to substrate 300 although there are spinning processes for applying a barrier layer (see, for example, layer 335 in FIG. 6).

Next, ink feed slot 500 (refer to FIG. 6) is formed by etching a feed slot from a back side (in other words, the side of the substrate opposing the side over which the thin films are deposited) and to the passivation layer (box 1165). The passivation layer stops the etch process so that the passivation layer remains overhanging over ink feed slot 400. The barrier layer 330 then is patterned to define ink feed channels from each opening 520 to each firing resistor 410 (box 1170).

After defining the barrier layer an orifice layer 335 is formed over barrier layer 330 (box 1175). An exemplary orifice layer is made of electroplated metal. Alternatively, the barrier layer 330 and orifice layer 335 can also be formed by photoimaging an integral polymer layer.

After the barrier and orifice layers are formed, the multiplexing circuits 315 or 810 and external circuitry 325 or 830 for transmitting signals to the substrate 300 or 800 are electrically coupled to input pads (such as input pads 470 of FIG. 4) formed in the substrate 300 or 800 (box 1180). In this embodiment, multiplexing circuits 315 or 810 are electrically coupled or bonded to input pads that are interior to substrate 300 or 800 and external circuitry is electrically coupled to input pads that are adjacent to the periphery of substrate 300 or 800.

The process of FIG. 11 provides a structure whereby ink can flow from the ink feed slot 400, through feed holes 520, and to firing resistors 410. Signals from external circuitry 325 are transmitted to substrate 300. Substrate 300 includes input traces 450 that transmit the signals to devices 315. Devices 315 decode or otherwise multiplex the signals from input traces 450 and then output firing signals or pulses along output traces 460 in response, thereby activating or actuating resistors 410.

In a final alternative embodiment, thin film transistors are formed in substrate 300 or 800 prior to forming the thin films that are described with respect to FIG. 11. The thin film transistors can be utilized to process information on printhead 300. Alternatively, the thin film transistors can be fabricated of sufficient dimension to allow for the driving of resistors 410. In this alternative embodiment, it is preferable to use high resistance resistors 410 (such as resistors having a resistance value above 70 ohms).

The foregoing description of the preferred embodiments of the invention has been presented for the purposes of illustration and description. It is not intended to be exhaustive or to limit the invention to the precise form disclosed. Accordingly, the foregoing description should be regarded as illustrative rather than restrictive, and it should be appreciated that variations may be made in the embodiments described by workers skilled in the art without departing from the scope of the present invention as defined by the following claims.

What is claimed is:

1. A printhead comprising:

a flat panel substrate made of a non-crystalline material;

an array of inkjet drop generators formed onto the flat panel substrate to define an inkjet printhead; and thin film transistors formed on the flat panel substrate that are electrically coupled to the array of ink jet drop generators.

2. The printhead of claim 1, wherein the flat panel substrate is at least one inch in extent.

3. The printhead of claim 1, wherein the flat panel substrate is at least two inches in extent.

4. The printhead of claim 1, wherein the flat panel substrate is at six inches in extent.

5. The printhead of claim 1, wherein the thin film transistors are multiplexing devices that are not separate from the flat panel substrate.

6. The printhead of claim 1, wherein the flat panel substrate is a monolithic flat panel having thin film circuitry defined on the flat panel and wherein the non-crystalline material is a ceramic.

7. A fluid ejection device, comprising:

a single monolithic flat panel substrate defining at least a portion of the fluid ejection device;

a large array of ink ejection elements formed on the single flat panel substrate made of a first material; and driver device circuits integrated with a secondary substrate that is attached and electrically coupled to thin film circuits of the flat panel substrate, wherein the secondary substrate is made from a second material that is different from the first material.

8. The fluid ejection device of claim 7, wherein the driver device circuits are attached to pads formed on the monolithic flat panel substrate at a location that is interior to the monolithic flat panel substrate.

9. The fluid ejection device of claim 8, wherein the pads are arranged along a peripheral location of the monolithic flat panel substrate and in electrical communication with a circuit external to the monolithic flat panel substrate.

10. The fluid ejection device of claim 7, wherein the driver device circuits are attached to the monolithic flat panel substrate by a flip chip process.

11. The fluid ejection device of claim 7, wherein the monolithic flat panel substrate is made of a non-crystalline material.

12. The fluid ejection device of claim 11, wherein the non-crystalline material comprises ceramic.

13. A method of manufacturing a large array inkjet printhead comprising:

providing a base flat panel substrate having a minimum size as a panel having dimensions of 12 inches by 12 inches;

defining circuitry upon the base flat panel substrate by utilizing flat panel display photolithography; and forming ink jet drop generators coupled to the circuitry upon the base flat panel substrate.

14. The method of claim 13, wherein the circuitry includes power transistors for providing power to the drop generators.

15. The method of claim 14, wherein the power transistors are thin film transistors.

16. The method of claim 13, wherein the circuitry includes multiplexing circuitry for providing power signals to the drop generators.

17. The method of claim 13, further comprising attaching multiplexing devices to the base flat panel substrate.

18. The method of claim 13, wherein the base flat panel substrate is at least partially formed of a non-crystalline material.

19. A large array inkjet printhead manufactured by the method of claim 17.

20. A fluid ejection device, comprising:

means for providing a flat panel substrate that is made of a non-crystalline material;

means for forming an array of inkjet drop generators onto the flat panel substrate to define an inkjet printhead; and means for forming thin film transistors on the flat panel substrate that are electrically coupled to the array of ink jet drop generators.

21. The fluid ejection device of claim 20, wherein the flat panel substrate is at least one inch in extent.

22. The fluid ejection device of claim 20, wherein the thin film transistors are multiplexing devices that are not separate from the flat panel substrate.

23. The fluid ejection device of claim 20, wherein the flat panel substrate is a monolithic flat panel having thin film circuitry defined on the flat panel and wherein the non-crystalline material is a ceramic.

* * * * *

UNITED STATES PATENT AND TRADEMARK OFFICE

CERTIFICATE OF CORRECTION

PATENT NO. : 6,921,156 B2
APPLICATION NO. : 10/439403
DATED : July 26, 2005
INVENTOR(S) : Winthrop D. Childers et al.

It is certified that error appears in the above-identified patent and that said Letters Patent is hereby corrected as shown below:

In column 1, lines 12-18, below "FIELD OF THE INVENTION" delete "The present invention includes as one embodiment a printhead including a flat panel substrate made of a non-crystalline material, an array of inkjet drop generators formed onto the flat panel substrate to define an inkjet printhead and thin film transistors formed on the flat panel substrate that are electrically coupled to the array of ink jet drop generators." and insert -- The present invention relates in general to thermal inkjet (TIJ) printheads and more specifically to a large array printhead having a large array of TIJ thin-film ink drop generators formed on a single monolithic substrate. --, therefor.

In column 2, lines 19-67 and column 3, lines 1-3, below "SUMMARY OF THE INVENTION" delete "To overcome the limitations in the prior art as described above, and to overcome other limitations that will become apparent upon reading and understanding the present specification, the present invention is embodied in a large array printhead having a large array of ink drop generators formed on a single monolithic substrate. The present invention provides an inexpensive large array printhead that uses a single monolithic substrate so that the need to align multiple substrates is alleviated. Moreover, the single monolithic substrate is made from a suitable material so that the size of the substrate is not limited.

The large array printhead of the present invention includes a large array of ink drop generators that are formed on a single monolithic substrate. The printhead includes a driver device circuit (preferably a multiplexing device) that reduces the number of incoming leads to the ink drop generators and decreases the parasitic resistance of the printhead. Preferably, the multiplexing device is on the back of the substrate so that it does not interfere with the printing operations on a print media. The ink drop generators are a layered thin-film structure formed on the substrate using thin-film techniques. These layers include a resistor layer, for heating ink from an ink source to a high temperature to cause an ink drop ejection and a barrier layer, for providing necessary structure to form a firing chamber and ink feed holes, which provide ink to the resistor. These layers also include an orifice layer that contains a nozzle from which the ink drop is ejected. Another embodiment of the invention includes a barrier layer having a plurality of ink feed holes and another embodiment includes a large array printhead having a plurality of chambers that may contain different ink colors.

The present invention is also embodied in a plurality of techniques that are used to fabricate the above-described large array printhead. These techniques include etching and patterning the layered thin-film structure on the substrate. In a preferred embodiment, the substrate is etched and patterned first and then the multiplexing device is attached at a later time. Attachment may be accomplished using several techniques including soldering the device to the substrate. Moreover, flat panel techniques and equipment may be used to fabricate the large array printhead of the present invention.

Other aspects and advantages of the present invention as well as a more complete understanding thereof will become apparent from the following detailed description, taken in conjunction with the accompanying drawings, illustrating by way of example the principles of the invention. Moreover, it is intended that the scope of the invention be limited by the claims and not by the preceding summary or the following detailed description." and insert -- The present invention includes as one embodiment a printhead including a flat panel substrate made of a non-crystalline material, an array of inkjet drop generators formed onto the flat panel substrate to define an inkjet printhead and thin film transistors formed on the flat panel substrate that are electrically coupled to the array of ink jet drop generators. --, therefor.

In column 12, line 28, in Claim 4, insert -- least -- before "six".

Signed and Sealed this

Sixteenth Day of March, 2010

David J. Kappos

David J. Kappos
*Director of the United States Patent and Trademark Office*